United States Patent [19]

Masaki et al.

[11] Patent Number: 4,891,291

[45] Date of Patent: Jan. 2, 1990

[54] PHOTOSENSITIVE MEMBER HAVING AN AMORPHOUS CARBON OVERCOAT LAYER

[75] Inventors: Kenji Masaki; Izumi Osawa; Masanori Fujiwara; Yumiko Takedomi, all of Osaka, Japan

[73] Assignee: Minolta Camera Kabushiki Kaisha, Osaka, Japan

[21] Appl. No.: 165,086

[22] Filed: Mar. 7, 1988

[30] Foreign Application Priority Data

| | | | |
|---|---|---|---|
| Mar. 9, 1987 | [JP] | Japan | 62-53624 |
| Mar. 9, 1987 | [JP] | Japan | 62-53625 |
| Mar. 9, 1987 | [JP] | Japan | 62-53626 |

[51] Int. Cl.[4] ..... G03G 5/14

[52] U.S. Cl. ..... 430/66; 430/85

[58] Field of Search ..... 430/58, 66, 85

[56] References Cited

U.S. PATENT DOCUMENTS

| | | | |
|---|---|---|---|
| 3,956,525 | 5/1986 | Yasuba | 427/41 |
| 4,340,404 | 2/1984 | Hosoya et al. | 430/58 |
| 4,366,208 | 12/1982 | Akai et al. | 428/421 |
| 4,394,425 | 7/1983 | Shimizu et al. | 430/65 |
| 4,490,450 | 12/1984 | Shimizu et al. | 430/57 |
| 4,544,617 | 10/1985 | Mort et al. | 430/58 |
| 4,559,289 | 12/1985 | Sunagawa et al. | 430/66 |
| 4,634,648 | 1/1987 | Jansen et al. | 430/84 |
| 4,675,265 | 6/1987 | Kazama et al. | 430/67 |
| 4,749,636 | 6/1988 | Iino et al. | 430/128 |
| 4,755,444 | 7/1988 | Karakida et al. | 430/66 |
| 4,770,965 | 9/1988 | Fender et al. | 430/66 |
| 4,770,966 | 9/1988 | Kazama et al. | 430/84 |

FOREIGN PATENT DOCUMENTS

| | | |
|---|---|---|
| 50-30526 | 3/1975 | Japan . |
| 51-46130 | 4/1976 | Japan . |
| 53-23636 | 3/1978 | Japan . |
| 53-111734 | 9/1978 | Japan . |
| 54-115134 | 9/1979 | Japan . |
| 55-86169 | 6/1980 | Japan . |
| 56-62254 | 5/1981 | Japan . |
| 57-64239 | 4/1982 | Japan . |
| 58-139154 | 8/1983 | Japan . |
| 59-58432 | 4/1984 | Japan . |
| 59-58437 | 4/1984 | Japan . |
| 60-101541 | 6/1985 | Japan . |
| 60-249155 | 12/1985 | Japan . |
| 61-94056 | 5/1986 | Japan . |
| 1174171 | 12/1969 | United Kingdom . |

OTHER PUBLICATIONS

A. Dilkes, S. Kaplan, and A. Vanlaeken, "A C-NMR Investigation of Plasma Polymerized Ethane, Ethylene, and Acetylene", Xerox Webster Research Center.

"Formation of an Amorphous Powder During the Polymerization of Ethylene in a Radio-Frequency Discharge", *Journal of Applied Polymer Science,* vol. 17, 1973, New York.

*A Review of Recent Advances in Plasma Polymerization,* Shen and Bell, Dept. of Chem. Engineering, U of Calif. Berkeley CA 94720.

*Thin Solid Films,* vol. 119 (1984) 121-126, "Optical and Interfacial Electronic Properties of Diamond-Like Carbon Films".

Philisophical Magazine, 1976, vol. 33, No. 6, 935-949, "Electronic Properties of Substantially Doped Amorphous Si and Ge", Spear et al.

Nikkei New Materials, Dec. 15, 1986.

*Primary Examiner*—John L. Goodrow

*Attorney, Agent, or Firm*—Burns, Doane, Swecker & Mathis

[57] ABSTRACT

A photosensitive member of the present invention comprises an electrically conductive substrate, a photoconductive layer and an overcoat layer.

The photoconductive layer comprises selenium-arsenic alloy layer, or selenium layer and selenium-tellurium layer formed in this order. The overcoat layer comprises amorphous carbon containing hydrogen and contains at least one or more elements selected from the group consisting of chalcogen and elements in Group III and IV of the periodic table.

The photosensitive member of this construction is harmless and excellent in electrophotographic characteristics inclusive of durability and surface hardness.

6 Claims, 3 Drawing Sheets

PHOTOSENSITIVE MEMBER HAVING AN AMORPHOUS CARBON OVERCOAT LAYER

BACKGROUND OF THE INVENTION

1. Field of the Invention

The present invention relates to a photosensitive member comprising an overcoat layer on a monolayer construction of selenium-arsenic alloy or a laminate-layer construction of selenium-tellurium alloy.

2. Description of the Prior Art

Photosensitive members of amorphous selenium have been well known, and there have been many attempts to improve the disadvantages in heat resistance, spectral sensitivity, dark decay and the like, of such members. For example, arsenic is doped into a selenium layer, or selenium-tellurium alloy layer is formed on a selenium layer to obtain a photosensitive member of laminated structure.

It has conventionally been well known that photosensitive members composed of selenium-arsenic alloys (hereinafter referred to as Se-As) have the highest photosensitivity in spectral luminous efficiency of all the members and that members comprising a selenium layer having a selenium tellurium layer (hereinafter referred to as Se-Te) laminated thereon, have the highest sensitivity to long wavelength light which is required for printers using semiconducting laser beams as a light source.

However, conventional Se-As and Se-Te photosensitive members in common use have disadvantages. One disadvantage is that they are harmful to the human body. Although it is nearly impossible for the photosensitive member to come into direct contact with the human body, when such a photosensitive member is used in a copy machine, powder from said member adheres to the copy image due to surface friction caused by the member rubbing against the copy paper, cleaning materials, developer or other matter, and the powder is then discharged from the machine. Accordingly, when the copy is picked up by hand the person is directly contaminated by the selenium, arsenic and tellurium, the harmfulness of said substances being a matter for concern. Another disadvantage is poor durability. The surface hardness of Se-As and Se-Te photosensitive members barely meets the H level of the JIS standards for pencil lead hardness, consequently, the surface is readily damaged when friction is generated during use of the machine as described previously, or repeated harsh surface contact is made during paper jams and the resultant reversion to manual remedies. This damage markedly reduces the image quality due to so-called whiteouts on the copy image, and shortens the useful life span of the photosensitive material.

In order to eliminate these disadvantages, the surface of the Se-As or Se-Te photosensitive member is covered with a protective layer.

For example, Japanese Unexamined Patent Publications No. SHO 53-23636 and SHO 53-111734 disclose photosensitive members having a specific silicide applied on a selenium, selenium-tellurium alloy, and selenium-cadmium alloy photoconductive layers and hardened to form an insulating layer. Japanese Unexamined Patent Publication No. SHO 59-58437, discloses a photosensitive member having an amorphous Si:N or Si:O layer 50 angstroms to 2 microns thick formed on a selenium-arsenic alloy layer by the glow discharge process using silane gas and ammonia gas, or silane gas and nitrous oxide gas as starting materials. Japanese Unexamined Patent Publication No. SHO 60-61761 discloses a photosensitive member having an amorphous carbon or hard carbon layer formed on a photosensitive layer.

However, photosensitive members disclosed in Japanese Unexamined Patent Publications Nos. SHO 53-23636 and 53-111734 has a drawback in that the surface of the members are readily damaged due to its poor surface hardness. Photosensitive members disclosed in Japanese Unexamined Patent Publications Nos. SHO 59-58437 and 60-61761 produce so-called image drift under high temperature and humidity conditions. Particularly, the latter publication discloses a photoconductive layer of amorphous silicon. Therefore, when this technique is applied to the members composed of selenium, there arises a problem of reduced chargeability.

As apparent from the above, there is no disclosure in these publications of any means for resolving the basic disadvantages inherent in the aforementioned Se-As and Se-Te photosensitive members.

SUMMARY OF THE INVENTION

A main object of the present invention is to provide a non-injurious photosensitive member generally superior in electrophotographic characteristics and having high durability.

Still another object of the invention is to provide an overcoat layer of high hardness which has superior adhesion properties on the photosensitive member.

A further object of the invention is to provide a photosensitive member having an overcoat layer which does not separate from said member when put into actual service in a copy machine.

These and other objects of the present invention are achieved by providing a photosensitive member comprising a conductive substrate, a photosensitive layer formed by a selenium-arsenic alloy monolayer, or selenium and selenium tellurium alloy layers formed in sequence, and an amorphous carbon overcoat layer provided over the photosensitive layer, said overcoat layer comprising at least one or more atoms selected from the group consisting of chalcogen and elements in Group III and I of the periodic table.

BRIEF DESCRIPTION OF THE DRAWINGS

In the following description, like parts are designated by like reference numbers throughout the several drawings.

DETAILED DESCRIPTION OF THE PREFERRED EMBODIMENTS

Figure 1:
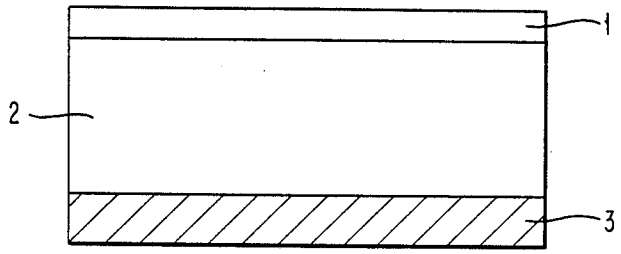
FIG. 1 is a diagram showing a photosensitive member embodying the invention.

FIG. 1 shows an example of the construction of a photosensitive member of the present invention wherein a conductive substrate 3 has sequentially laminated thereon a photosensitive layer 2 and an overcoat layer 1 formed of an amorphous hydrocarbon layer A photosensitive layer 2 is formed of a single layer composed of selenium-arsenic alloys (hereinafter referred to as Se-As member) on a conductive substrate 3, or formed of a selenium layer having a selenium-tellurium layer laminated thereon, on a conductive substrate 3 (hereinafter referred to as Se-Te member).

The conductive substrate 3 may be at a minimum a material which is conductive on its outermost surface, and may be a cylindrical shape, a flexible belt, a flat plate, or another arbitrary shape.

The characteristics of the present invention is an overcoat layer 1 having at least one or more elements selected from the group consisting of chalcogen and elements in Group III and IV of the periodic table in an amorphous carbon layer (hereinafter referred to as an a-C layer).

The amorphous carbon layer itself has a hardness rating of 4H, but becomes harder and damage resistant by means of the addition of at least one or more elements selected from the group of chalcogen and elements in Group III and IV of the periodic table, the addition of said atoms providing an overcoat layer 1 which has comparatively superior moisture resistance, assures suitable chargeability, and has superior transparency to light.

The amounts of chalcogen atoms and elements in Group III of the periodic table to be present in the a-C layer of the present invention is preferably about 0.1 to 20 atomic %, more preferably about 0.5 to 20 atomic %, and most preferably about 1.0 to 20 atomic % based on all the constituent atoms of the a-C layer.

The amount of elements in Group IV of the periodic table to be present in the a-C layer of the present invention is preferably about 0.1 to 50; atomic %, more preferably about 0.5 to 30 atomic %, and most preferably about 1.0 to 20 atomic % based on all the constituent atoms of the a-C layer.

The content of less than 0.1 atomic % of these atoms is undesirable in view of moisture resistance. If the amount of IV atoms of the periodic table exceeds 50 atomic % based on all the constituent atoms of the a-C layer, the coefficient of light absorption increases. Therefore, the irradiating light cannot effectively be introduced into the selenium photosensitive layer to cause reduction of photosensitivity.

Although there is no particular limitation on the amount of the above-mentioned atoms which may be contained in the a-C layer, the amount is necessarily restricted from the perspectives of the overcoat layer manufacturing and glow discharge processes.

Although there is no particular limitation on the amount of the hydrogen atoms which may be contained in the a-C layer, the amount is necessarily restricted from the perspectives of the overcoat layer manufacturing and glow discharge processes, said amount being, in general, 30 to 60 atomic %.

The contents of these atoms in the a-C layer can be determined by a usual method of elementary analysis, e.g. Auger electron spectroscopy or IMA analysis. The a-C layer may contain chalcogen atoms and elements in Group III and IV of the periodic table singly, and may contain two or more of the above types of atoms.

The overcoat layer 1 of the present invention is formed at a thickness of 0.01 to 5 microns, preferably 0.05 to 2 microns, and ideally 0.1 to 1 microns. A layer with a thickness of less than 0.01 micron has reduced hardness and is readily damaged. Also, a layer with the thickness exceeding 5 microns has reduced transparency to light and causes reduced sensitivity of the photosensitive member because the exposed light cannot be effectively conducted to the selenium photosensitive layer.

The overcoat layer 1 of the photosensitive member of the present invention may be formed on an Se-As member or Se-Te member, thus achieving the objects of the present invention.

The overcoat layer 1 is formed by means of a glow discharge process. The overcoat layer 1 is formed by discharging, at reduced pressure, gaseous-phase molecules containing a least carbon atoms and molecules containing hydrogen atoms together with molecules at least containing one or more elements selected from the group consisting of chalcogen and elements in Group III and IV, thereby diffusing on the substrate the activated neutral atoms and charged atoms in the plasma production region, and being induced by electrical or magnetic force or the like to form on the substrate in solid phase via a recombination reaction. The formation of the overcoat layer 1 can be regulated via the aforesaid plasma reaction (hereinafter referred to as a P-CVD reaction) to form an amorphous hydrocarbon layer incorporating at least chalcogen atoms and Group III atoms and Group IV atoms of the periodic table.

These hydrocarbons need not always be in a gaseous phase at room temperature at atmospheric pressure but can be in a liquid or solid phase insofar as they can be vaporized on melting, evaporation or sublimation, for example, by heating or in a vacuum. Examples of useful hydrocarbons are saturated hydrocarbons, unsaturated hydrocarbons, alicyclic hydrocarbons, aromatic hydrocarbons and the like. Such hydrocarbons are usable in combination.

A wide variety of hydrocarbons are usable. Examples of useful saturated hydrocarbons are normal paraffins such as methane, ethane, propane, butane, pentane, hexane, heptane, octane, nonane, decane, undecane, dodecane, tridecane, tetradecane, pentadecane, hexadecane, heptadecane, octadecane, nonadecane, eicosane, heneicosane, docosane, tricosane, tetracosane, pentacosane, hexacosane, heptacosane, octacosane, nonacosane, triacontane, dotriacontane, pentatriacontane, etc.; isoparaffins such as isobutane, isopentane, neopentane, isohexane, neohexane, 2,3-dimethylbutane, 2-methylhexane, 3-ethylpentane, 2,2-dimethylpentane, 2,4-dimethylpentane, 3,3-dimethylpentane, tributane, 2-methylheptane, 3-methylheptane, 2,2-dimethylhexane, 2,2,5-dimethylhexane, 2,2,3-trimethylpentane, 2,2,4-trimethylpentane, 2,3,3-trimethylpentane, 2,3,4-trimethylpentane, isononane, etc.; and the like.

Examples of useful unsaturated hydrocarbons are olefins such as ethylene, propylene, isobutylene, 1-butene, 2-butene, 1-pentene, 2-pentene, 2-methyl-l-butene, 3-methyl-l-butene, 2-methyl-2-butene, 1-hexene, tetramethylethylene, 1-heptene, 1 -octene, 1-nonene, 1-decene and the like; diolefins such as allene, methylallene, butadiene, pentadiene, hexadiene, cyclopentadiene and the like; triolefins such as ocimene, alloocimene, myrcene, hexatriene and the like; acetylene, methylacetylene, 1-butyne, 2-butyne, 1-pentyne, 1-hexyne, 1-heptyne, 1-octyne, 1-nonyne, 1-decyne, butadiyine and the like.

Example of useful alicyclichydrocarbons are cycloparaffins such as cyclopropane, cyclobutane, cyclopentane, cyclohexane, cycloheptane, cyclooctane, cyclononane, cyclodecane, cycloundecane, cyclododecane, cyclotridecane, cyclotetradecane, cyclopentadecane, cyclohexadecane and the like; cycloolefins such as cyclopropene, cyclobutene, cyclopentene, cyclohexene, cycloheptene, cyclooctene, cyclononene, cyclodecene and the like; terpenes such as limonene, terpinolene, phellandrene, sylvestrene, thujene, carene, pinene, bornylene, camphene, fenchene, cyclofenchene, tricyclene, bisabolene, zingiberene, curcumene, humulene, cadinenesesquibenihene, selinene, caryophyllene, santalene, cedrene, camphorene, phyllocladene, podocarprene, mirene and the like; steroids; etc.

Examples of useful aromatic hydrocarbons are benzene, toluene, xylene, hemimellitene, pseudocumene, mesitylene, prenitene, isodurene, durene, pentamethylbenzene, hexamethylbenzene, ethylbenzene, propylbenzene, cumene, styrene, biphenyl, terphenyl, diphenylmethane, triphenylmethane, dibenzyl, stilbene, indene, naphthalene, Tetralin, anthracene, phenanthrene and the like.

The hydrogen content of the a-C layer of the invention is variable in accordance with the film forming apparatus and film forming conditions. The hydrogen content can be decreased, for example, by elevating the substrate temperature, lowering the pressure, reducing the degree of dilution of the starting materials, applying a greater power, decreasing the frequency of the alternating electric field to be set up, increasing the intensity of a d.c. electric field superposed on the alternating electric field or desired combination of such procedures.

Examples of molecules containing at least chalcogen atoms are $H_2S$, $CH_3(CH_2)_4S(CH_2)_4CH_3$, $CH_2{=}CHCH_2SCH_2CH{=}CH_2$, $C_2H_5SC_2H_5$, $C_2H_5SCH_3$, thiophene, $H_2Se$, $(C_2H_5)_2Se$, $H_2Te$ and the like.

Examples of molecules containing at least III element of the periodic table are $B_2H_6$, $BCl_3$, $BBr_3$, $BF_3$, $B(OC_2H_5)_3$, $AlCl_3$, $Al(Oi\text{-}C_3H_7)_3$, $(CH_3)_3Al$, $(C_2H_5)_3Al$, $(i\text{-}C_4H_8)_3Al$, $GaCl_3$, $GaBr_3$, $Ga(Oi\text{-}C_3H_7)_3$, $(CH_3)_3Ga$, $(C_2H_5)_3Ga$, $In(Oi\text{-}C_3H_7)_3$, $(C_2H_5)_3In$ and the like.

Examples of molecules containing at least IV element of the periodic table are $SiH_4$, $Si_2H_6$, $(C_2H_5)_3SiH$, $SiF_4$, $SiH_2Cl_2$, $SiCl_4$, $Si(OCH_3)_4$, $Si(OC_2H_5)_4$, $Si(OC_3H_7)_4$, $GeH_4$, $GeCl_4$, $GeF_4$, $Ge_2H_6$, $Ge(OC_2H_5)_4$, $Ge(C_2H_5)_4$, $(CH_3)_4Sn$, $(C_2H_5)_4Sn$, $SnCl_4$ and the like.

The amount of these atoms, i.e., chalcogen atoms and III and Group IV atoms of the periodic table, incorporated in the a-C layer can be regulated at least by means of increasing or decreasing the amount of molecules containing these atoms in the P-CVD reaction.

Figure 2:
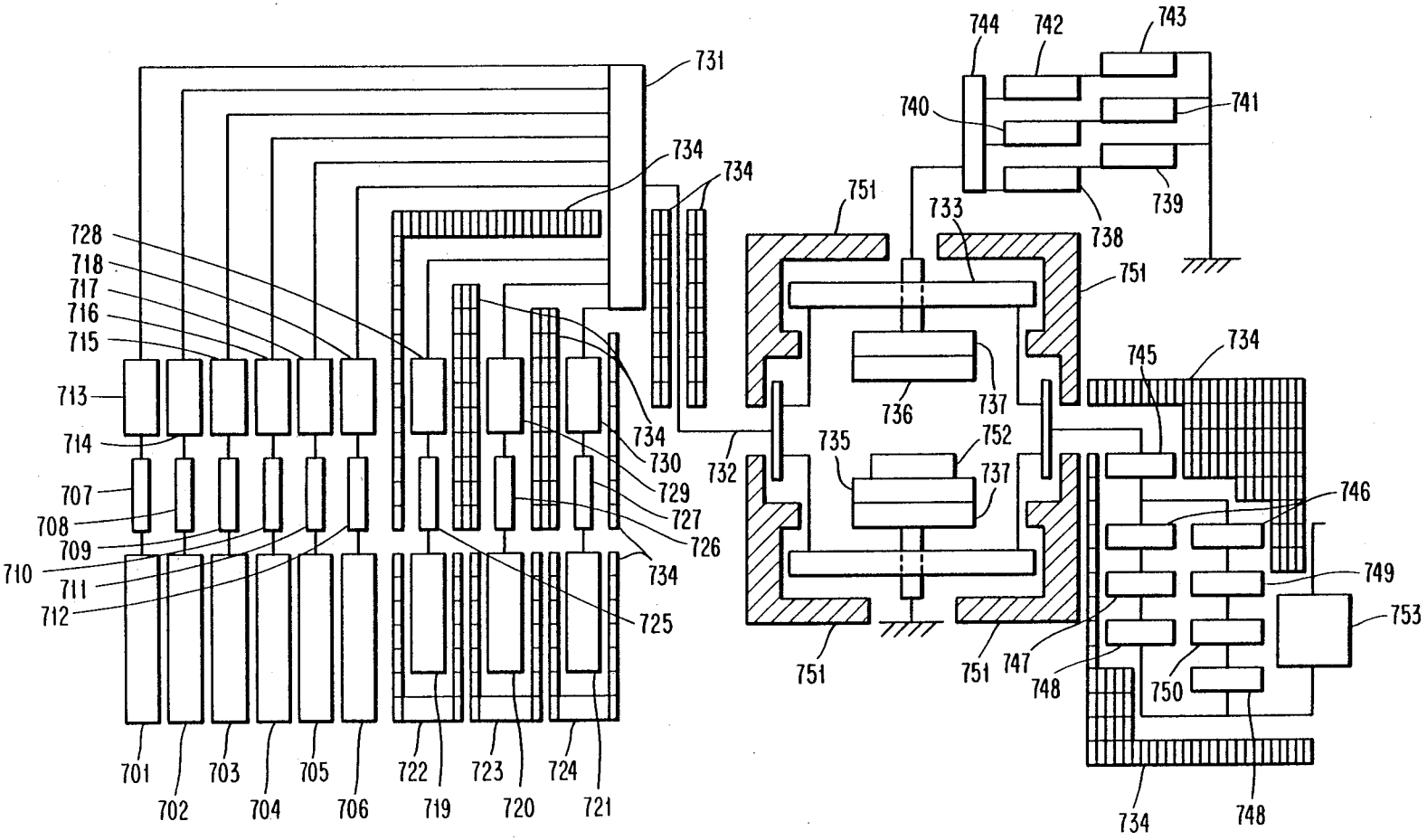
FIGS. 2 and 3 are diagrams showing apparatus for preparing photosensitive members of the invention.
Figure 3:
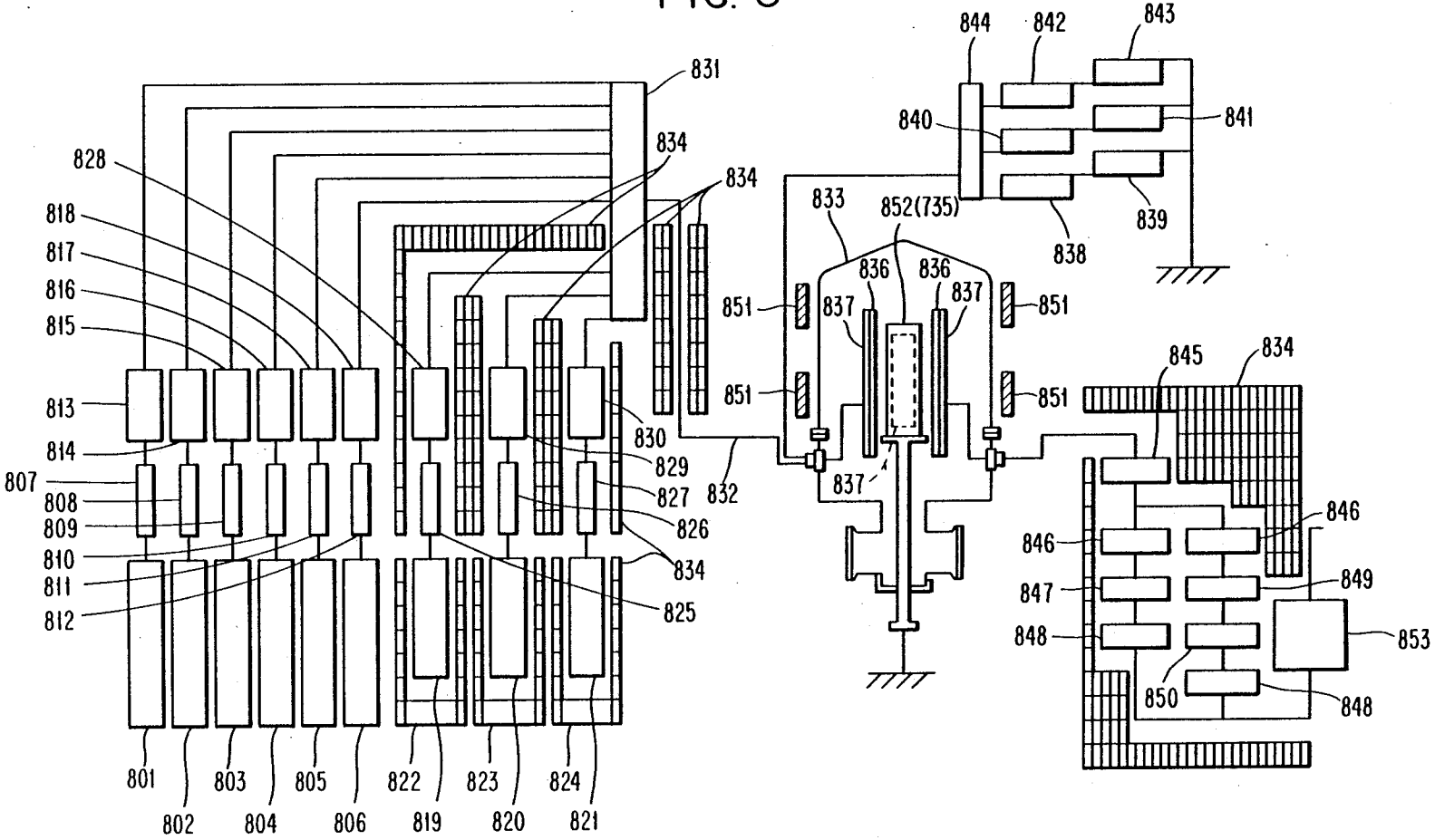

FIGS. 2 and 3 show single examples of a glow discharge decomposition apparatus for forming the overcoat layer of the present invention. FIG. 2 shows a plane-parallel plate P-CVD apparatus and FIG. 3 shows a cylindrical P-CVD apparatus.

First, an explanation of the apparatus shown in FIG. 2 follows hereinafter.

FIG. 2 shows an apparatus for preparing the photosensitive member of the invention. First to sixth tanks 701 to 706 have enclosed therein starting material compounds which are in gas phase at room temperature and a carrier gas and are connected respectively to first to sixth regulator valves 707 to 712 and first to sixth flow controllers 713 to 718. First to third containers 719 to 721 contain starting material compounds which are liquid or solid at room temperature, can be preheated by first to third heaters 722 to 724 for vaporizing the compounds, and are connected to seventh to ninth regulator valves 725 to 727 and seventh to ninth flow controllers 728 to 730, respectively. The gases to be used, as selected from among these gases, are mixed together by a mixer 731 and fed to a reactor 733 via a main pipe 732. The interconnecting piping can be heated by a pipe heater 734 which is suitably disposed so that the material compounds, in a liquid or solid phase at room temperature and vaporized by preheating, will not condense during transport. A grounded electrode 735 and a power application electrode 736 are arranged as opposed to each other within the reactor 733. Each of these electrodes can be heated by an electrode heater 737. The power application electrode 736 is connected to a high-frequency power source 739 via a high-frequency power matching device 738, to a low-frequency power source 741 via a low-frequency power matching device 740 and to a d.c. power source 743 via a low-pass filter 742. Power of one of the different frequencies is applicable to the electrode 736 by way of a connection selecting switch 744. The internal pressure of the reactor 733 is adjustable by a pressure control valve 745. The reactor 733 is evacuated by a diffusion pump 747 and an oil rotary pump 748 via an exhaust system selecting valve 746, or by a cooling-removing device 749, a mechanical booster pump 750 and an oil rotary pump 748 via another exhaust system selecting value 746. The exhaust gas is further made harmless by a suitable removal device 753 and then released to the atmosphere. The evacuation piping system can also be heated by a suitably disposed pipe heater 734 so that the material compound, which is liquid or solid at room temperature and vaporized by preheating, will not condense during transport. For the same reason, the reactor 733 can also be heated by a reactor heater 751. An electrically conductive substrate 752 is placed on the electrode 735 in the reactor. Although FIG. 2 shows that the substrate 752 is fixed to the grounded electrode 735, the substrate may be attached to the power application electrode 736, or to both the electrodes.

FIG. 3 shows another type of apparatus for preparing the photosensitive member of the invention. This apparatus has the same construction as the apparatus of FIG. 2 with the exception of the interior arrangement of the reactor 833. The numerals shown by 700 order in FIG. 2 are replaced by the numerals at 800 order in FIG. 8. With reference to FIG. 3, the reactor 833 is internally provided with a hollow cylindrical electrically conductive substrate 852 serving also as the grounded electrode 735 of FIG. 2 and with an electrode heater 837 inside thereof. A power application electrode 836, similarly in the form of a hollow cylinder, is provided around the substrate 852 and surrounded by an electrode heater 837. The conductive substrate 852 is rotatable about its own axis by a motor from the outside.

The reactors shown in FIGS. 2 and 3 for preparing the photosensitive member are first evacuated by the diffusion pump to a vacuum of about $10^{-4}$ to about $10^{-6}$ torr, whereby the adsorbed gas inside the reactor is removed. The reactor is also checked for the degree of vacuum. At the same time, the electrodes and the substrate fixedly placed on the electrode are heated to a predetermined temperature. A photosensitive member comprising a conductive substrate and a single photosensitive layer formed thereon and composed of selenium-arsenic alloys or a photosensitive layer composed of selenium layer having a selenium-tellurium layer laminated thereon may be used.

Subsequently, material gases are fed into the reactor from the first to sixth tanks and the first to third containers (i.e. from those concerned), each at a specified flow rate, using the flow controllers concerned, i.e. first to ninth flow controllers and the interior of the reactor is maintained in a predetermined vacuum by the pressure control valve. After the combined flow of gases has become stabilized, the high-frequency power source, for example, is selected by the connection selecting switch to apply a low-frequency power to the power application electrode. This initiates discharge across the two electrodes, forming a solid layer on the substrate with time. The thickness of the layer is controllable by varying the reaction time such that the discharge is discontinued upon the thickness reaching the desired value. Consequently, the a-C layer of the invention is obtained which serves as an overcoat layer.

The present invention will be described with reference to the following examples.

EXAMPLES 1 AND 2

Using a glow discharge decomposition apparatus shown in FIG. 3, an overcoat layer of the present invention for a photosensitive member was prepared.

First, the interior of the reactor 733 was evacuated to a high vacuum of about $10^{-6}$ torr, and the first, second and third regulator valves 707, 708 and 709 were thereafter opened to introduce hydrogen gas from the first tank 701, butadiene gas from the second tank 702 and hydrogen sulfide gas from the third tank 703 into the first flow controller 713, the second flow controller 714 and the third flow controller 715 respectively at an output pressure of 1.0 kg/cm$^2$. The dials on the flow controllers were adjusted to supply the hydrogen gas at a flow rate of 300 sccm, the butadiene gas at 60 sccm and the hydrogen sulfide gas at 10 sccm to the reactor 733 through the main pipe 732 via the intermediate mixer 731. After the flows of the gases were stabilized, the internal pressure of the reactor 733 was adjusted to 0.5 torr by the pressure control valve 745. On the other hand, the substrate 752 was used, said substrate being a cylindrical aluminum substrate measuring 80 mm in diameter and 330 mm in length and having an Se-As photosensitive layer (Example 1) and an Se-Te photosensitive layer (Example 2) previously formed thereon to a film thickness of approximately 50 microns in accordance with conventional methods and using a separate vacuum evaporation device. The temperature of substrate 752 was raised from room temperature to 50° C. about a 15 minute period prior to the introduction of the gases. With the gas flow rates and the pressure in stabilized state, 150-watt power with a frequency of 100 KHz was applied to the power application electrode 736 from the low-frequency power source 741 preconnected thereto by the selecting switch 744 to conduct plasma polymerization for 2 minutes, forming an a-C layer, 0.25 microns in thickness, as an overcoat layer. After completion of the film formation, the power supply was discontinued, the regulator valves except for the one for hydrogen gas were all closed. Then, only the hydrogen gas was introduced into the reactor 733 at a flow rate of 200 sccm with a pressure of 10 Torr, to decrease the temperature of the substrate to 30° C. for about 15 minutes. Thereafter, the regulator valves for hydrogen gas was closed, whereupon the vacuum was broken and the photosensitive member of the present invention was removed.

When subjected to organic quantitative analysis and Auger electron spectroscopy, the a-C layer thus obtained was found to contai 45 atomic % of hydrogen atoms and 3.7 atomic % of chalcogen atoms, i.e., sulfur atoms based on all the constituent atoms contained therein.

Characteristics:

The overcoat layers obtained in Examples 1 and 2 had a surface hardness of about 6H based on measurements for pencil lead hardness as provided in Japanese Industrial Standards JIS K-5400, and it is understood that the high degree of surface hardness was a marked improvement.

Furthermore, when the photosensitive member obtained in Example 1 was measured for white light sensitivity using the normal Carlson process, the amount of light required for light decay was 0.99 lux-sec, and since the measured value prior to the manufacture of the overcoat layer was about 0.93 lux-sec., it is understood that the overcoat layer of the present invention does not impair the inherent sensitivity of the Se-As photosensitive member. Also, the photosensitive member obtained in Example 2 had measured for photosensitivity of 780 nm using the normal Carlson process, the amount of light required for light decay was about 5.2 erg/cm$^2$, and since the measured value prior to the manufacture of the overcoat layer was about 5.0 erg/cm$^2$, it is understood that the overcoat layer of the photosensitive member of the present invention does not impair the inherent sensitivity of the Se-Te photosensitive member.

In addition, the photosensitive members obtained in Examples 1 and 2 were exposed to atmospheric conditions of low temperature-low humidity (10° C. and 30% humidity) and high temperature-high humidity (50° C. and 90% humidity) which were alternated every 30 minutes each over a 6 hour period, and cracking or separation of the overcoat layer was not observed, from which results it is understood that the photosensitive member having the overcoat layer of the present invention has superior adhesive properties regarding its adhesion to the Se-As and Se-Te photosensitive layers.

Further, when the photosensitive member obtained in Example 1 was installed in a Minolta Model EP 650Z copy machine and copies made, clear images were obtained. In addition, so-called image drift was not observed when copies were made under environmental conditions of 35° C. temperature and 80% humidity. Neither was any separation of the overcoat layer noted when said layer came into contact with the developer, copy paper, and cleaning components within the copy machine. Under normal room conditions, 250,000 copies were made and clear images were obtained to the last. Additionally, the surface was subjected to component analysis after making the 250,000 copies using Auger analysis, neither selenium nor arsenic were detected. From these results, it can be understood that the overcoat layer of the present invention decreased the harmful aspects and increased durability, while it did not impair image quality.

When the photosensitive member obtained in Example 2 was installed in a Minolta Model EP 450Z copy machine and copies made using an optical system modified to a conventional semiconductor laser exposure system comprising a semiconductor laser, polygon mirror scanner, drive system and the like, clear images were obtained. In addition, so-called image drift was not observed when copies were made under environmental conditions of 35° C. temperature and 80% humidity. Neither was any separation of the overcoat layer noted when said layer came into contact with the developer, copy paper, and cleaning components within the copy machine. Under normal room conditions, 250,000 copies were made and clear images were obtained to the last. Additionally, the surface was subjected to component analysis after making the 250,000 copies using Auger analysis and neither selenium, tellurium, or the like were detected. From these results, it can be understood that the overcoat layer of the present invention improved the harmful aspects and increased durability while it did not impair image quality.

EXAMPLES 2 TO 12

Photosensitive members were prepared in a manner similar to Example 1, each member comprising a photosensitive layer and an overcoat layer provided in this order as shown in FIG. 1.

Table 1 shows the various condition values for forming an overcoat layer. Table 1 shows the conditions different from Example 1 for forming an overcoat layer and classified into 17 items (1) to (17). These items are described at the top column of the Table. Some condition values shown at each item are common to each example, while others vary in each example.

Table 1 shows the items (1) to (17) as follows:

(1) flow rate of hydrogen gas from the first tank (701) (sccm)
(2) flow rate of material gas from the second tank (702) (sccm)
(3) flow rate of dopant gas from the third tank (703) (sccm)
(4) flow rate of dopant gas from the fourth tank (704) (sccm)
(5) flow rate of dopant gas from the first container (719) (sccm)
(6) temperature of the first heater (722) (°C.)
(7) pressure (Torr)
(8) temperature of the substrate (°C.)
(9) time for heating the substrate (minute)
(10) dimension of the substrate (diameter × length) (unit: mm)
(11) power (watt)
(12) time for plasma polymerization (minute)
(13) thickness of the layer (micron)
(14) frequency from the power source (KHz)
(15) hydrogen content (atomic %)
(16) and (17) content of dopant contained in the overcoat layer (atomic %)
(18) photosensitive layer on which the overcoat layer is formed. In this, A represents Se-As layer and B represents Se-Te layer
(19) thickness of the photosensitive layer Characteristics:

The photosensitive members obtained in Examples 2 to 12 have almost the same characteristics as that in Example 1. From these results, it can be understood that the overcoat layer of the present invention improved the harmful aspects an increased durability while it did not impair image quality.

TABLE 1

| Ex. No | (1) sccm | (2) sccm | (3) sccm | (4) sccm | (5) sccm | (6) °C. | (7) Torr | (8) °C. | (9) min | (10) mm | (11) watt | (12) min | (13) μm | (14) KHz | (15) at. % | (16) at. % | (17) at. % | (18) | (19) μm |
|---|---|---|---|---|---|---|---|---|---|---|---|---|---|---|---|---|---|---|---|
| 3 | 250 | $C_4H_6$ 60 | $H_2S$ 5 | — — | — — | — | 2.0 | 50 | 15 | 80 × 330 | 100 | 1.3 | 0.3 | 50 | 43 | S 1.1 | — | A | 50 |
| 4 | 250 | $C_4H_6$ 60 | $H_2S$ 5 | — — | — — | — | 2.0 | 50 | 15 | 80 × 330 | 100 | 1.3 | 0.3 | 50 | 43 | S 1.1 | — | B | 50 |
| 5 | 200 | $C_4H_6$ 60 | *1:100 $SiH_4$ | — — | — — | — | 0.5 | 50 | 15 | 80 × 330 | 150 | 2 | 0.3 | 100 | 45 | Si 9.8 | — | A | 50 |
| 6 | 200 | $C_4H_6$ 60 | *1:100 $SiH_4$ | — — | — — | — | 0.5 | 50 | 15 | 80 × 330 | 150 | 2 | 0.3 | 100 | 45 | Si 9.8 | — | B | 50 |
| 7 | 250 | $C_4H_6$ 60 | *2:50 $GeH_4$ | — — | — — | — | 2.0 | 50 | 15 | 80 × 330 | 100 | 1 | 0.3 | 50 | 43 | Ge 5.1 | — | A | 50 |
| 8 | 250 | $C_4H_6$ 60 | *2:50 $GeH_4$ | — — | — — | — | 2.0 | 50 | 15 | 80 × 330 | 100 | 1 | 0.3 | 50 | 43 | Ge 5.1 | — | B | 50 |
| 9 | 200 | $C_4H_6$ 60 | *1:100 $B_2H_6$ | — — | — — | — | 0.5 | 50 | 15 | 80 × 330 | 150 | 2 | 0.25 | 100 | 45 | B 3.2 | — | A | 50 |
| 10 | 200 | $C_4H_6$ 60 | *1:100 $B_2H_6$ | — — | — — | — | 0.5 | 50 | 15 | 80 × 330 | 150 | 2 | 0.25 | 100 | 45 | B 3.2 | — | B | 50 |
| 11 | 250 | $C_4H_6$ 60 | — — | — — | $(CH_3)_3$ Al 5 | 35 | 0.25 | 50 | 15 | 80 × 330 | 150 | 2 | 0.25 | 100 | 45 | Al 1.0 | — | A | 50 |
| 12 | 250 | $C_4H_6$ 60 | — — | — — | $(CH_3)_3$ Al 5 | 35 | 0.25 | 50 | 15 | 80 × 330 | 150 | 2 | 0.25 | 100 | 45 | Al 1.0 | — | B | 50 |

(1) The gases with a mark *1 are diluted to a concentration of 20% with hydrogen.
(2) The gases with a mark *2 are diluted to a concentration of 10% with hydrogen.
(3) $(CH_3)_3Al$ at column 5 in Table 1 means trimentl aluminum.
(4) $(C_4H_6$ at column 2 Table 1 means butadiene.
(5) In Examples 3 to 12, after completion of the film formation, the power supply was discontinued, the regulator valves except for the one hydrogen gas were all closed. Then, only the hydrogen gas was introduced into the reactor 733 at a flow rate of 200 sccm with a pressure of 10 torr to decrease the temperature of the substrate to 30° C. for about 15 minutes.

COMPARATIVE EXAMPLES 1 AND 2

Overcoat layers were formed on an Se-As photosensitive member (Comparative Example 1) and an Se-Te photosensitive member (Comparative Example 2) as per Examples 1 and 2 except for omitting the inflow of hydrogen sulfide gas.

The overcoat layers obtained in Comparative Examples 1 and 2 had a surface hardness of about 4H based on measurements for pencil lead hardness as provided in Japanese Industrial Standards JIS K-5400, and it is understood that these members had a lower surface hardness compared with those in Examples 1 and 2. This indicates that the addition of chalcogen atoms into the overcoat layer improves the surface hardness thereof.

Subsequently, when these photosensitive members were installed in copy machines and continuous copy operations performed, the surface of the members was charged to a half amount of those in Examples 1 and 2 to thereby obtain images with poor density.

Further, so-called image drift was produced when these photosensitive members were installed in copy machines and continuous copy operations performed under environmental conditions of 35° C. temperature and 80% humidity.

After completion of the field tests, the photosensitive members obtained in Comparative Examples 1 and 2 were exposed to atmospheric conditions of low temperature-low humidity (10° C. and 30% humidity) and high temperature-high humidity (50° C. and 90% humidity) which were alternate every 30 minutes each over a six hour period, with the result that the overcoat layers gradually separated from the photosensitive layers.

COMPARATIVE EXAMPLES 3 AND 4

Overcoat layers were formed on an Se-As photosensitive member (Comparative Example 3) and an Se-Te photosensitive member (Comparative Example 4) as per Examples 5 and 6 except that the silane gas was not introduced and the flow rate of hydrogen gas was increased to 300 sccm.

The obtained test materials exhibited poor moisture resistance and produced image drift under high temperature conditions prior to use in resistance tests, thus confirming their impracticality.

COMPARATIVE EXAMPLES 5 AND 6

Overcoat layers were formed on an Se-As photosensitive member (Comparative Example 5) and an Se-Te photosensitive member (Comparative Example 6) as per Examples 7 and 8 except that germane gas ($GeH_4$), which was not diluted with hydrogen, was introduced at a flow rate of 150 sccm and the flow rate of hydrogen gas was decreased to 150 sccm.

When subjected to organic quantitative analysis and Auger electron spectroscopy, the a-C layer thus obtained was found to contain 24 atomic % of hydrogen atoms and 53 atomic % of germanium atoms based on all the constituent atoms contained therein.

Characteristics:

When these photosensitive members were installed in copy machines and continuous copy operations performed, photosensitivity was reduced to a half of those in Examples 7 and 8. This indicates that the amount of incident light to the photosensitive layers is decreased due to high light absorption coefficient of the overcoat layer, causing reduced photosensitivity. From this result, it is understood that the addition of excess amount of Group IV atoms is undesirable.

COMPARATIVE EXAMPLES 7 AND 8

Overcoat layers were formed on an Se-As photosensitive member (Comparative Example 7) and an Se-Te photosensitive member (Comparative Example 8) as per Examples 7 and 8 except that silane gas was not introduced and the flow rate of hydrogen gas was increased to 300 sccm.

The obtained test materials exhibited poor moisture resistance and produced image drift under high temperature conditions prior to use in resistance tests, thus confirming their impracticality.

What is claimed is:

1. A photosensitive member comprising:
   an electrically conductive substrate;
   a photoconductive layer comprising a selenium-arsenic alloy layer or comprising a selenium layer and selenium-tellurium layer formed in this order; and
   an overcoat layer formed on said photoconductive layer and comprising amorphous carbon containing hydrogen, said overcoat layer containing at least one element selected from the group consisting of chalcogen and elements in Group III and IV of the periodic table, said overcoat layer having a thickness of from about 0.01 to about 5 microns and being formed by plasma polymerization.

2. A photosensitive member as claimed in claim 1 wherein the amount of the hydrogen contained in the overcoat layer is about 30 to 60 atomic % based on the combined amount of hydrogen and carbon therein.

3. A photosensitive member as claimed in claim 1 wherein the amount of the chalcogen contained in the overcoat layer is about 0.1 to about 20 atomic % based on all the constituent atoms therein.

4. A photosensitive member as claimed in claim 1 wherein the amount of the elements in Group III of the periodic table contained in the overcoat layer is about 0.1 to 20 atomic % based on all the constituent atoms therein.

5. A photosensitive member as claimed in claim 1 wherein the amount of the elements in Group IV of the periodic table contained in the overcoat layer is about 0.1 to about 50 atomic % based on all the constituent atoms therein.

6. A photosensitive member comprising:
   an electrically conductive substrate;
   a photoconductive layer comprising a selenium-arsenic alloy layer or comprising a selenium layer and selenium-tellurium layer formed in this order; and
   an overcoat layer formed on said photoconductive layer and comprising amorphous carbon containing hydrogen in an amount of about 30 to about 60 atomic % based on the combined amount of hydrogen and carbon, said overcoat layer containing at least one element selected from the group consisting of chalcogen and elements in Group III and IV of the periodic table, said overcoat layer having a thickness of from about 0.01 to about 5 microns and being formed by plasma polymerization.

* * * * *